US009406218B1

(12) United States Patent
Ray

(10) Patent No.: US 9,406,218 B1
(45) Date of Patent: Aug. 2, 2016

(54) CHIN-OPERATED REMOTE CONTROL

(71) Applicant: Jamel L. Ray, Lawrence, NY (US)

(72) Inventor: Jamel L. Ray, Lawrence, NY (US)

( * ) Notice: Subject to any disclaimer, the term of this patent is extended or adjusted under 35 U.S.C. 154(b) by 156 days.

(21) Appl. No.: 14/468,391

(22) Filed: Aug. 26, 2014

(51) Int. Cl.
*G08C 17/00* (2006.01)

(52) U.S. Cl.
CPC ..... *G08C 17/00* (2013.01)

(58) Field of Classification Search
CPC ..... A61B 5/6803; A61B 5/6814; A61G 2203/18; A61G 2203/30; G05G 1/52
USPC ..... 340/12.2, 12.22
See application file for complete search history.

(56) References Cited

U.S. PATENT DOCUMENTS 3,161,846 A * 12/1964 Wagner ..... A61B 5/1114 338/67
3,229,059 A * 1/1966 Beatty ..... A61G 12/00 200/61.41
3,586,798 A * 6/1971 Holmes ..... H01H 35/003 200/52 R
4,078,627 A * 3/1978 Brown ..... A61G 5/045 180/316
4,093,037 A 6/1978 Miller, III
4,260,035 A * 4/1981 Loveless ..... A61G 5/04 180/6.5
4,486,630 A * 12/1984 Fetchko ..... H01H 3/14 200/52 R
4,582,325 A * 4/1986 Yuhara ..... A63B 69/3608 434/252
4,679,644 A * 7/1987 Loveless ..... A61G 5/04 180/6.5
4,865,610 A 9/1989 Muller
D326,117 S 5/1992 Cordell et al.
5,227,575 A * 7/1993 Mishima ..... G10H 1/053 84/670
7,071,844 B1 7/2006 Moise
7,091,875 B2 8/2006 Ondracek
8,044,766 B2 10/2011 Ghovanloo
9,194,977 B1 * 11/2015 Dungan ..... G01V 7/00
2003/0032461 A1 * 2/2003 Desrosiers ..... H04M 1/05 455/569.2
2011/0151941 A1 * 6/2011 Chan ..... B65H 75/4431 455/569.1
2015/0209646 A1 * 7/2015 DiMartino ..... A63B 71/085 128/861

* cited by examiner

*Primary Examiner* — Fekadeselassie Girma
*Assistant Examiner* — Stephen Burgdorf
(74) *Attorney, Agent, or Firm* — Kyle A. Fletcher, Esq.

(57) ABSTRACT

The chin-operated remote control is a housing that is configured to rest against a chest of an end user. The housing includes a retractable cord that extends to a chinstrap. The chinstrap is configured to be mounted on a chin of an end user such that upon moving of the head of said end user, the retractable cord moves left, right, extends, and retracts. The retractable cord relays said movement in order to operate a remote control provided inside of the housing. An antenna and a plurality of buttons are provided on the housing. The remote control is adapted for use with an electronic appliance.

15 Claims, 5 Drawing Sheets

CHIN-OPERATED REMOTE CONTROL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of remote controls, more specifically, a remote control that is configured to be manually operated about a chin and upper torso of an end user.

SUMMARY OF THE INVENTION

An embodiment of the disclosure meets the needs presented above by generally comprising a housing that is configured to rest against a chest of an end user. The housing includes a retractable cord that extends to a chinstrap. The chinstrap is configured to be mounted on a chin of an end user such that upon moving of the head of said end user, the retractable cord moves left, right, extends, and retracts. The retractable cord relays said movement in order to operate a remote control provided provided on the housing. The remote control is adapted for use with an electronic appliance.

These together with additional objects, features and advantages of the chin-operated remote control will be readily apparent to those of ordinary skill in the art upon reading the following detailed description of presently preferred, but nonetheless illustrative, embodiments of the chin-operated remote control when taken in conjunction with the accompanying drawings.

In this respect, before explaining the current embodiments of the chin-operated remote control in detail, it is to be understood that the chin-operated remote control is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the chin-operated remote control.

It is therefore important that the claims be regarded as including such equivalent construction insofar as they do not depart from the spirit and scope of the chin-operated remote control. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
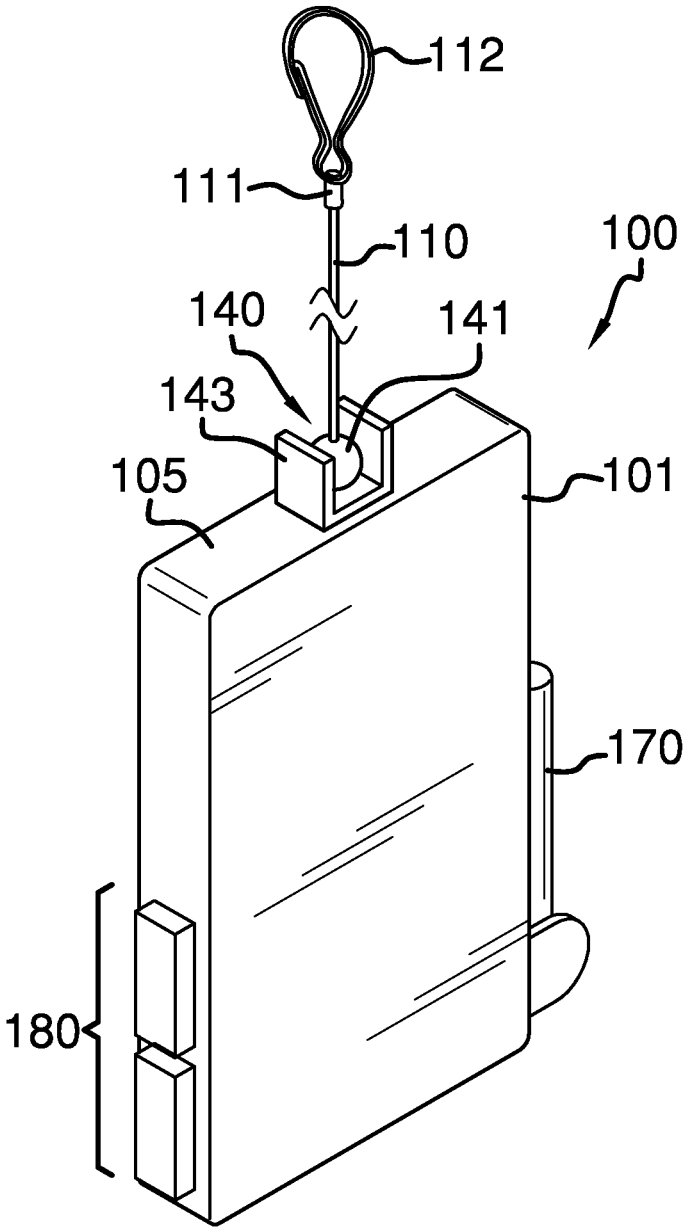
FIG. 1 is a perspective view of an embodiment of the disclosure.
Figure 2:
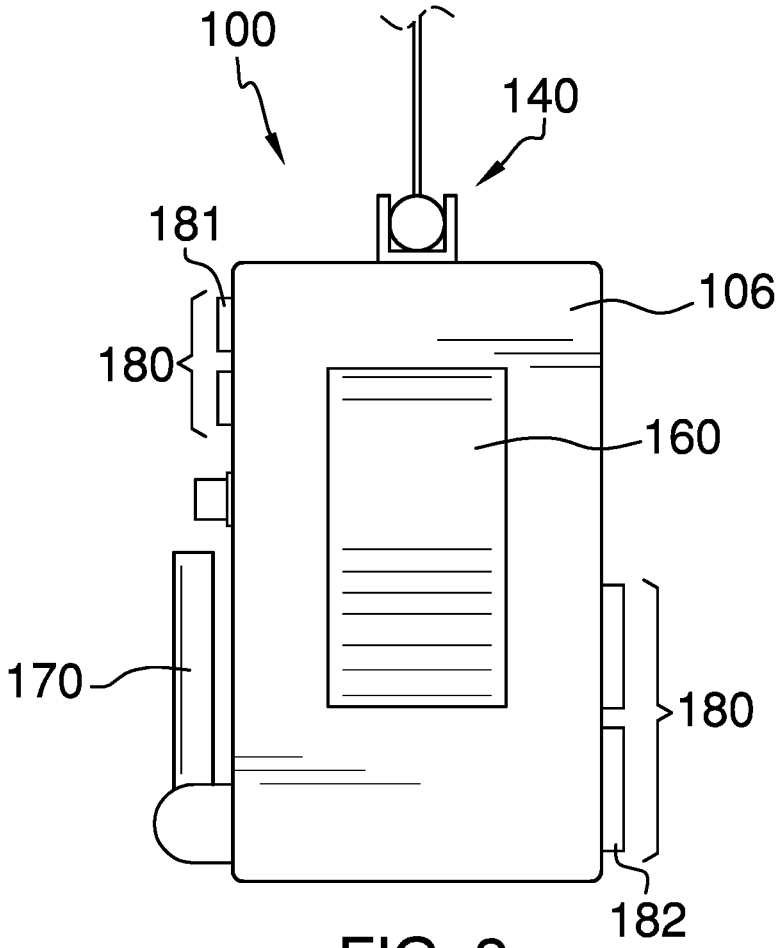
FIG. 2 is a rear view of an embodiment of the disclosure.
Figure 3:
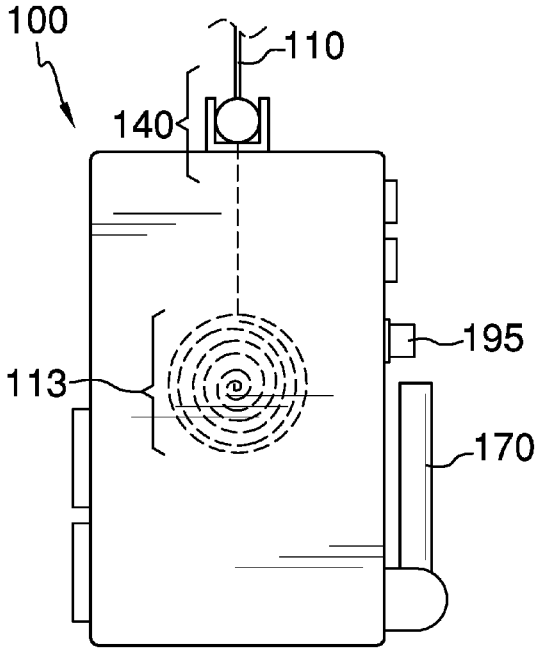
FIG. 3 is a front view of an embodiment of the disclosure.
Figure 4:
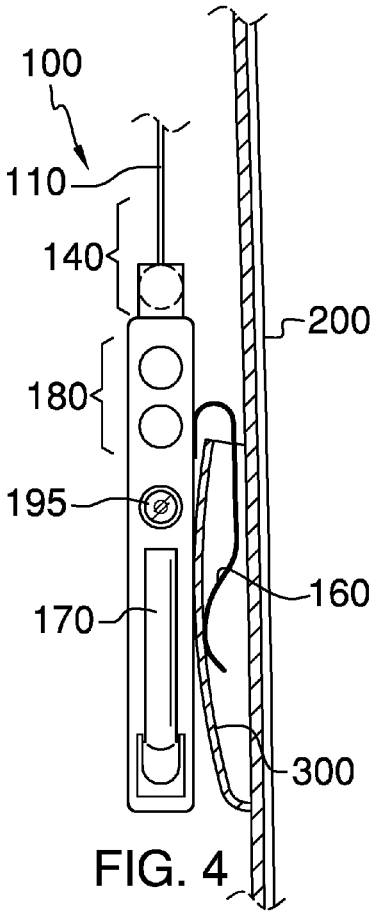
FIG. 4 is a side view of an embodiment of the disclosure.
Figure 5:
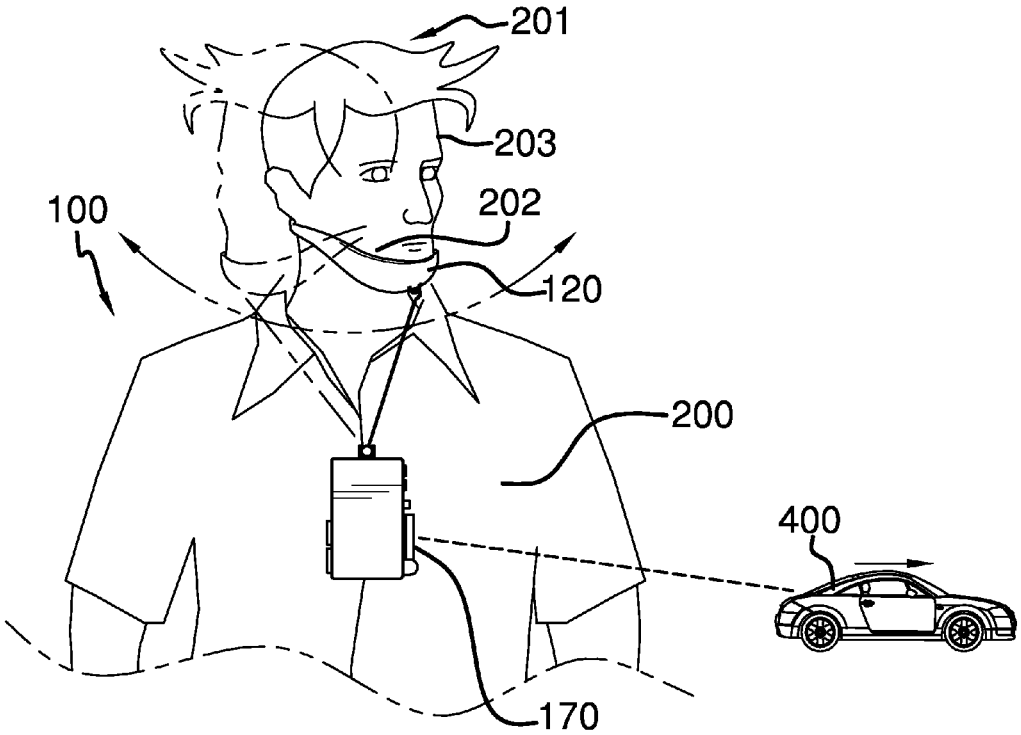
FIG. 5 is an in-use view of an embodiment of the disclosure.
Figure 6:
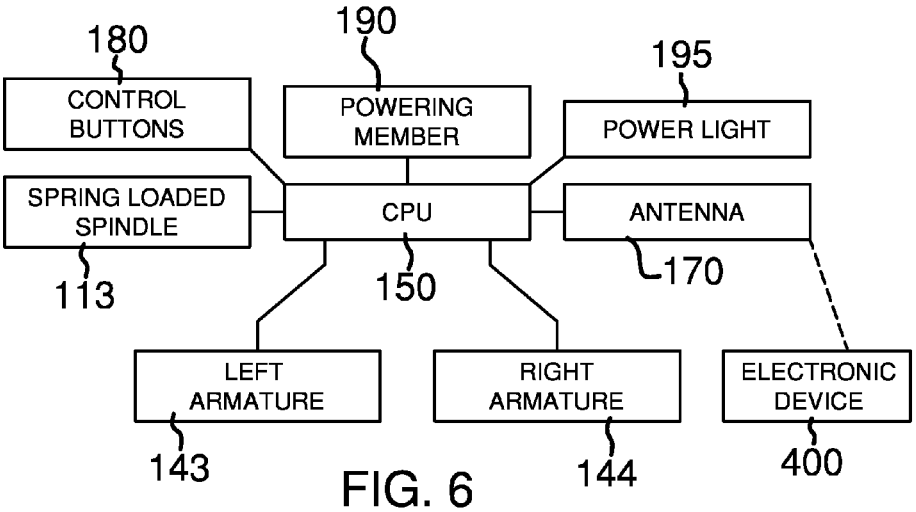
FIG. 6 is a block diagram of the componentry associated with an embodiment of the disclosure.
Figure 7:
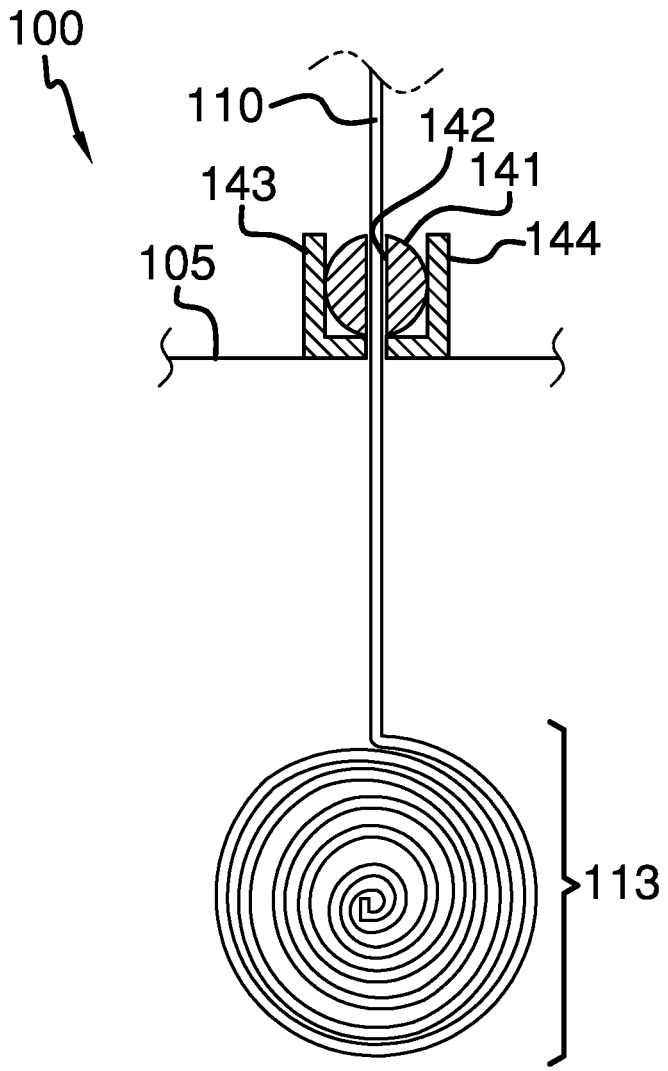
FIG. 7 is a detail of an embodiment of the disclosure.

As best illustrated in FIGS. 1 through 7, the chin-operated remote control 100 (hereinafter invention) generally comprises a housing 101 that is configured to rest against a chest 200 of an end user 201. The housing 101 includes a retractable cord 110 that extends to a chinstrap 120.

The chinstrap 120 is configured to be mounted on a chin 202 of the end user 201 such that upon moving of a head 203 of said end user 201, the retractable cord 110 moves left, right, extends, and retracts. The retractable cord 110 is further defined with a distal end 111 with a clip 112 mounted thereon. The clip 112 is able to secure to the chinstrap 120. The retractable cord 110 is wound on a spring-loaded spool 113 located inside of the housing 101. The spring-loaded spool 113 enables the retractable cord 110 to extend and retract with respect to the housing 101. Moreover, a navigation switch 140 is mounted on a top housing surface 105. The navigation switch 140 includes a ball member 141 with a hole 142 there through. The hole 142 of the ball member 141 enables the retractable cord 110 to extend and retract there through.

The navigation switch 140 includes a left armature 143 and a right armature 144. The left armature 143 and the right armature 144 are located on opposing sides of the ball member 141. The ball member 141 is able to move back and forth between the left armature 143 and the right armature 144 in order to detect left and right movement of the chinstrap 120. Touching of the ball member 141 to either the left armature 143 or the right armature 144 signals a CPU 150. That being said, the left armature 143 as well as the right armature 144 are in wired communication with the CPU 150. It shall be further noted that the spring-loaded spool 113 is in wired communication with the CPU 150 so as to detect extension and retraction of the retractable cord 110.

The housing 101 includes a rear surface 106 that includes a clothing clip 160 thereon. The clothing clip 160 is configured to clip onto clothing 300 of the end user 201. The housing 101 may include an antenna 170 and a plurality of buttons 180. The antenna 170 enables wireless communication with an electronic device 400 that is to be controlled via the invention 100. The electronic device 400 may be any item that is able to be operated with a remote control, and comprising a television or remote-controlled car.

The plurality of buttons 180 include a menu button 181, and an on/off button 182. The CPU 150 is in wired communication with a powering member 190, which comprises at least one battery. The powering member 190 is contained within the housing 101. The powering member 190 supplies electricity to all componentry associated with the invention 100, and is well known in the art. The housing 101 may further include a power light 195 that provides visual confirmation that the invention 100 is operational.

The combination of the navigation switch 140 and the spring-loaded spool 113 enables the CPU 150 to detect left, right, extension, and retraction movement of the retractable cord 110, and which in turn is used to transmit a signal via the antenna 170 to the electronic device 400 remotely.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A chin-operated remote control comprising:

a retractable cord that extends and retracts from a housing;

said housing is configured to be placed adjacent to a chest of an end user;

a chinstrap attaches to the retractable cord;

said chinstrap is configured to attach to a chin of an end user;

movement of said chin of said end user, shall be detected via a spring-loaded spool and navigation switch, and relayed as a remote control signal that is adapted to operate an electronic device remotely;

wherein said retractable cord is further defined with a distal end with a clip mounted thereon; wherein the clip is able to secure to the chinstrap; wherein the retractable cord is wound on said spring-loaded spool located inside of the housing;

wherein the spring-loaded spool enables the retractable cord to extend and retract with respect to the housing;

wherein said navigation switch is mounted on a top housing surface; wherein the navigation switch includes a ball member with a hole there through;

wherein said hole of the ball member enables the retractable cord to extend and retract there through.

2. The chin-operated remote control according to claim 1 wherein said navigation switch includes a left armature and a right armature.

3. The chin-operated remote control according to claim 2 wherein said left armature and the right armature are located on opposing sides of the ball member.

4. The chin-operated remote control according to claim 3 wherein said ball member is able to move back and forth between the left armature and the right armature in order to detect left and right movement of the chinstrap.

5. The chin-operated remote control according to claim 4 wherein touching of the ball member to either the left armature or the right armature signals a CPU.

6. The chin-operated remote control according to claim 5 wherein the left armature as well as the right armature are in wired communication with the CPU; wherein the spring-loaded spool is in wired communication with the CPU so as to detect extension and retraction of the retractable cord.

7. The chin-operated remote control according to claim 6 wherein said housing includes a rear surface that includes a clothing clip thereon; wherein the clothing clip is configured to clip onto clothing of the end user.

8. The chin-operated remote control according to claim 7 wherein said housing includes an antenna thereon as well as a plurality of buttons.

9. The chin-operated remote control according to claim 8 wherein said antenna enables wireless communication with the electronic device that is to be controlled via the CPU; wherein the plurality of buttons include a menu button, and an on/off button.

10. The chin-operated remote control according to claim 9 wherein said CPU is in wired communication with a powering member, which comprises at least one battery; wherein the powering member is contained within the housing.

11. The chin-operated remote control according to claim 10 wherein said housing includes a power light that provides visual confirmation of operation of the chin-operated remote control.

12. A chin-operated remote control comprising:

a retractable cord that extends and retracts from a housing;

said housing is configured to be placed adjacent to a chest of an end user;

a chinstrap attaches to the retractable cord;

said chinstrap is configured to attach to a chin of an end user;

movement of said chin of said end user, shall be detected via a spring-loaded spool and navigation switch, and relayed as a remote control signal that is adapted to operate an electronic device remotely;

wherein said retractable cord is further defined with a distal end with a clip mounted thereon; wherein the clip is able to secure to the chinstrap; wherein the retractable cord is wound on said spring-loaded spool located inside of the housing;

wherein the spring-loaded spool enables the retractable cord to extend and retract with respect to the housing;

wherein said navigation switch is mounted on a top housing surface; wherein the navigation switch includes a ball member with a hole there through;

wherein said hole of the ball member enables the retractable cord to extend and retract there through; wherein said navigation switch includes a left armature and a right armature; wherein said left armature and the right armature are located on opposing sides of the ball member.

13. The chin-operated remote control according to claim 12 wherein said ball member is able to move back and forth between the left armature and the right armature in order to detect left and right movement of the chinstrap; wherein touching of the ball member to either the left armature or the right armature signals a CPU; wherein the left armature as well as the right armature are in wired communication with the CPU; wherein the spring-loaded spool is in wired communication with the CPU so as to detect extension and retraction of the retractable cord; wherein said housing includes a rear surface that includes a clothing clip thereon; wherein the clothing clip is configured to clip onto clothing of the end user.

14. The chin-operated remote control according to claim 13 wherein said housing includes an antenna thereon as well as a plurality of buttons; wherein said antenna enables wireless communication with the electronic device that is to be controlled via the CPU; wherein the plurality of buttons include a menu button, and an on/off button.

15. The chin-operated remote control according to claim 14 wherein said CPU is in wired communication with a powering member, which comprises at least one battery; wherein the powering member is contained within the housing; wherein said housing includes a power light that provides visual confirmation of operation of the chin-operated remote control.

* * * * *